United States Patent [19]

Owen

[11] 4,025,746

[45] May 24, 1977

[54] REMOTE CONTROL MEANS FOR A BALANCED LINE SWITCH SYSTEM

[76] Inventor: Kenneth Owen, 6201 Hibbling Ave., Springfield, Va. 22150

[22] Filed: Jan. 31, 1975

[21] Appl. No.: 545,949

Related U.S. Application Data

[62] Division of Ser. No. 457,615, April 3, 1974, Pat. No. 3,885,117.

[52] U.S. Cl. ..... 200/179; 200/180

[51] Int. Cl.² ..... H01H 67/00

[58] Field of Search ..... 200/153 S, 175–179, 200/1 R, 180; 335/69, 118; 307/140; 318/467

[56] References Cited

UNITED STATES PATENTS

| | | | |
|---|---|---|---|
| 2,516,606 | 7/1950 | Weaver et al. | 200/153 S UX |
| 2,702,877 | 2/1955 | Noon | 200/153 S X |
| 2,709,725 | 5/1955 | Bieber et al. | 200/153 S X |
| 2,990,523 | 6/1961 | Jacques | 200/153 S X |
| 3,885,117 | 5/1975 | Owen | 200/153 S |

*Primary Examiner*—James R. Scott
*Attorney, Agent, or Firm*—Kenneth L. King

[57] ABSTRACT

A switch system for interconnecting a plurality of balanced line inputs with a plurality of balanced line outputs is disclosed. The lines are crossed in a matrix with a pair of rotatable switch means mounted at each crosspoint. Each pair of the switch means provides straight through connections for the input and output lines while in a first position, and a cross connection at the matrix point while in a second position. The switch means provides identical path lengths for each side of the balanced line before and after switching. The switch system also includes means for grounding the unused contacts and the inactive line sections remaining in the matrix after an interconnection has been made. The matrix is formed of a plurality of interchangeable modules that allow quick and convenient expansion of the matrix when needed.

9 Claims, 21 Drawing Figures

FIG 4
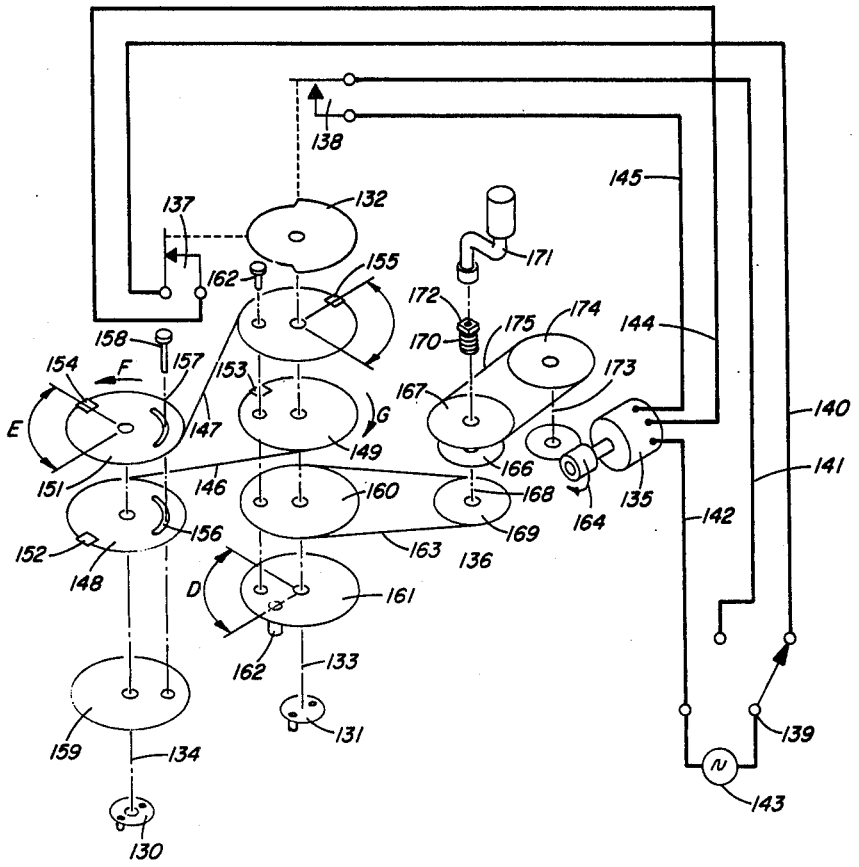
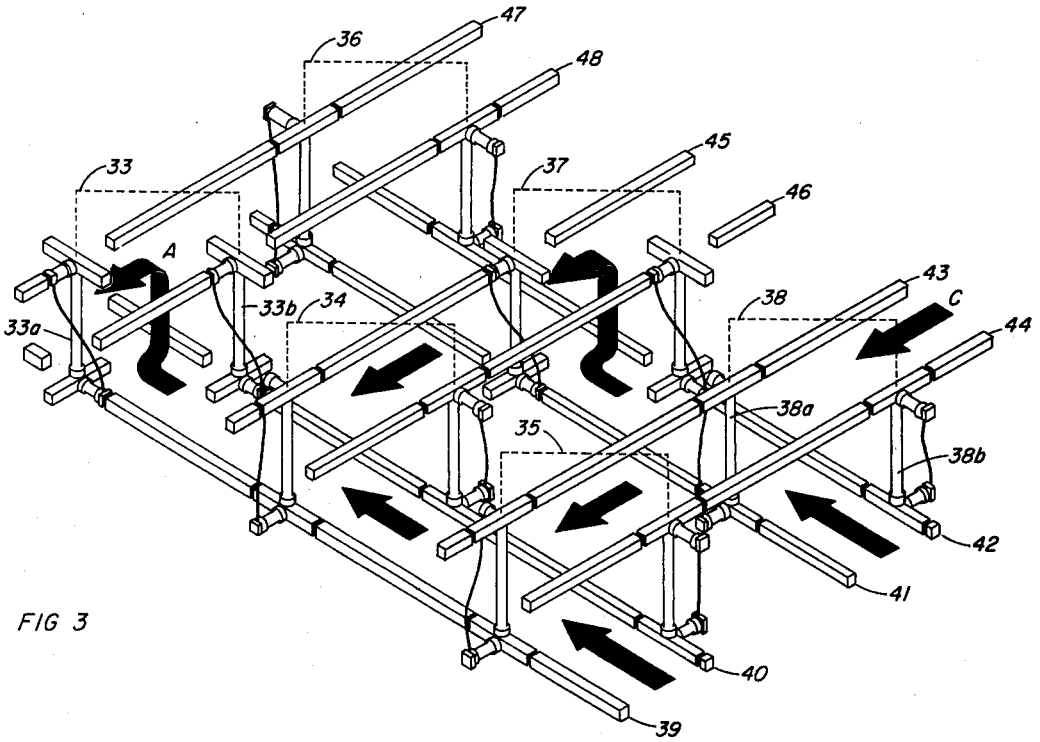
FIG 3

FIG 21
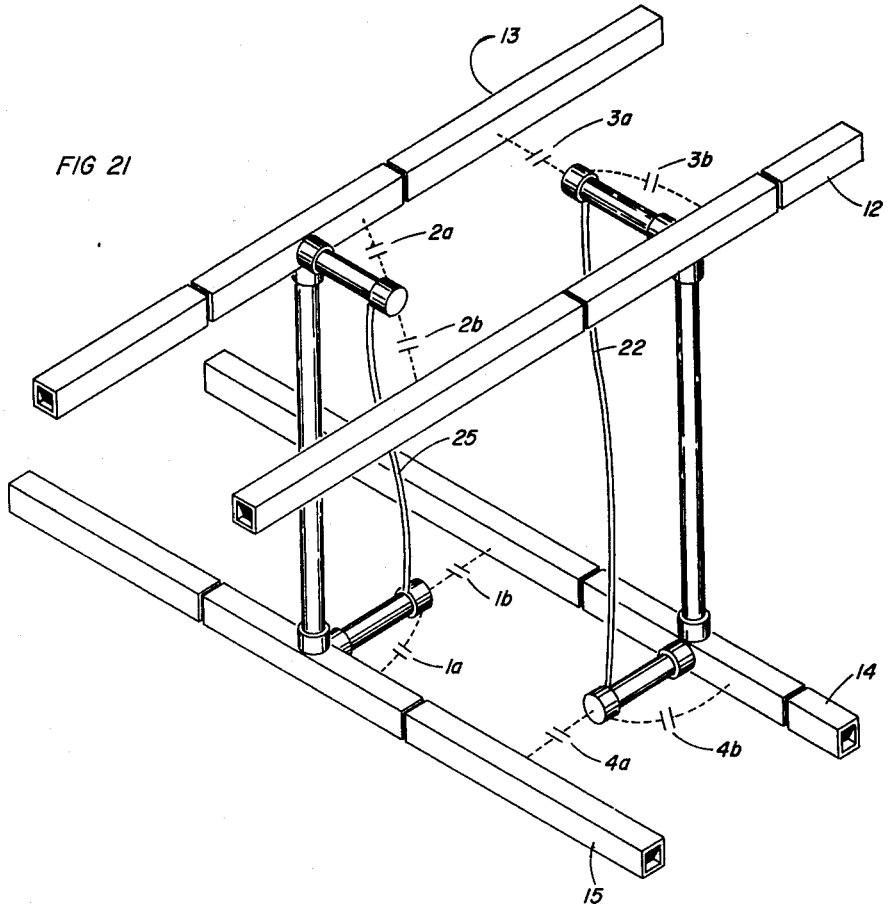
FIG 19
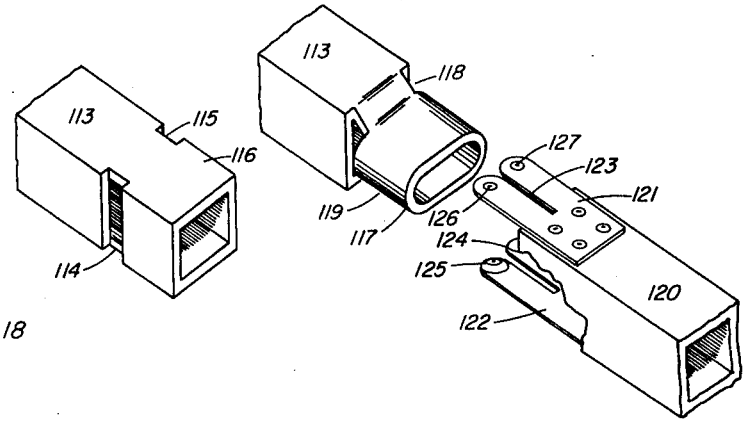
FIG 18
FIG 20

REMOTE CONTROL MEANS FOR A BALANCED LINE SWITCH SYSTEM

This is a division of application Ser. No. 457,615, filed Apr. 3, 1974, now U.S. Pat. No. 3,885,117.

BACKGROUND OF THE INVENTION

The present invention relates to a switch system for use in interconnecting a plurality of transmitters or receivers to any one of a plurality of antennas. These switch systems must be able to handle relatively large power inputs and loads and must be capable of selectively switching from one power input to any one of a plurality of loads quickly and conveniently. In the past, transmitters have been manually interconnected to various antennas to permit scheduling of variations in antenna characteristics. These interconnections are complex, awkward and require excessive time for each change.

DESCRIPTION OF THE PRIOR ART

In an attempt to solve the above problems, a variety of switch systems has been developed to provide quick and convenient interchange between a plurality of transmitters and a plurality of field antennas. These switch systems use a cross matrix wherein a plurality of input lines are arranged parallel to one another and a plurality of output lines are spaced apart from the input lines and arranged perpendicularly to the input lines to form a matrix. Various means have been proposed in the prior art to couple and uncouple the input and output lines. One of these prior art switch systems is disclosed in U.S. Pat. No. 3,717,736. This patent discloses a cross matrix with a plurality of balanced input lines and a plurality of balanced output lines running parallel to one another and crossed in a matrix arrangement. Reciprocating plungers are used at the intersecting points to provide through connections or interconnections between the input and output lines as desired.

SUMMARY OF THE INVENTION

It is an object of the present invention to provide a switch system for interconnecting a plurality of balanced input lines with a plurality of balanced output lines. It is particularly intended for use in the radio frequency spectrum, and relates to the switching of connections between antennas when the characteristic impedance of the switch system generally conforms to the corresponding impedance of the balanced lines leading from the transmitters to the antennas. The present invention is intended to provide a switch system for a source or load transfer wherein a given input line is connected to a given output line in a cross matrix configuration.

It is an object of the present invention to provide a switch system for a balanced line matrix that will preserve the characteristic impedance of the balanced line both before and after switching. Although total path length changes during switching, the respective path lengths of balanced line conductors before and after switching remain identical to each other thus maintaining perfect line balance.

It is another object of this invention to provide a switch system capable of very fast switching wherein the switch system may transfer the input power to any given antenna quickly and conveniently.

It is an object of the present invention to provide means for an RF switching system having a new and novel configuration for the contactor portions of the balanced line switch sections. This new and novel construction provides a long contact life having a mean time between failures much greater than that existing in the present prior art switches.

It is another object of this invention to provide a grounding means for grounding the unused rotor contacts to reduce to a minimum the "cross talk" between the crossing but unconnected input and output lines.

It is another object of the present invention to provide a mechanical configuration for the matrix that will prevent the inadvertent connection of more than one source line to a given output line, or more than one output line to a given input line.

It is another object of the present invention to provide a switch system having a modular configuration wherein the matrix is formed of a plurality of interchangeable modules that allow quick and convenient expansion of the matrix as desired.

It is another object of the invention to provide a mechanical configuration for the matrix that will not form "stub lines" on the conductor path either before or after switching.

It is another object of the invention to provide a balanced line RF switch with "triple throw" characteristics, that is a straight through connection, or connections to either side of the line in a single module.

BRIEF DESCRIPTION OF THE DRAWINGS

FIG. 3 is a diagrammatic and isometric illustration of a switch system of the present invention illustrating a switch matrix with two input lines and three output lines.

FIG. 4 is a diagrammatic and isometric view of the drive means used to rotate the rotors of the present invention together with a schematic illustration of the electrical circuitry involved.

FIG. 18 is an isometric view of a portion of a through connect contact before forming.

FIG. 19 is an isometric view of a portion of a through connect contact after forming.

FIG. 20 is an isometric view of the contact means used on the stationary strip line sections.

FIG. 21 is an isometric view of a portion of a switch module illustrating the inwardly turning cross connect contact assemblies with schematic illustrations of the stray capacitance formed between these assemblies and the line conductors.

DESCRIPTION OF THE PREFERRED EMBODIMENTS

Figure 1:
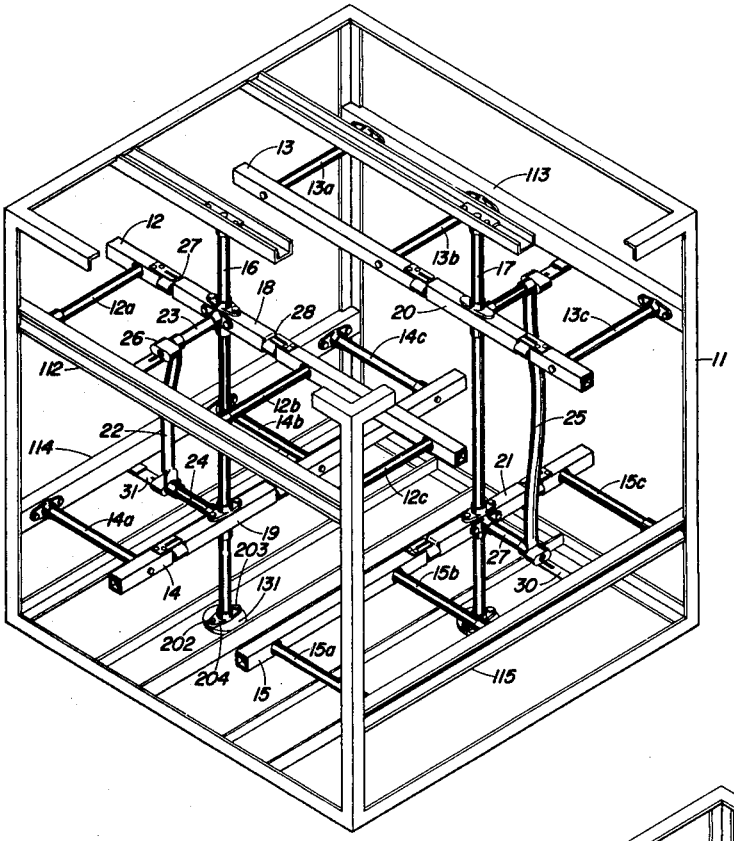
FIG. 1 is an isometric and partially broken view of a single switch module of the present invention illustrating the module in a through connect configuration.
Figure 2:
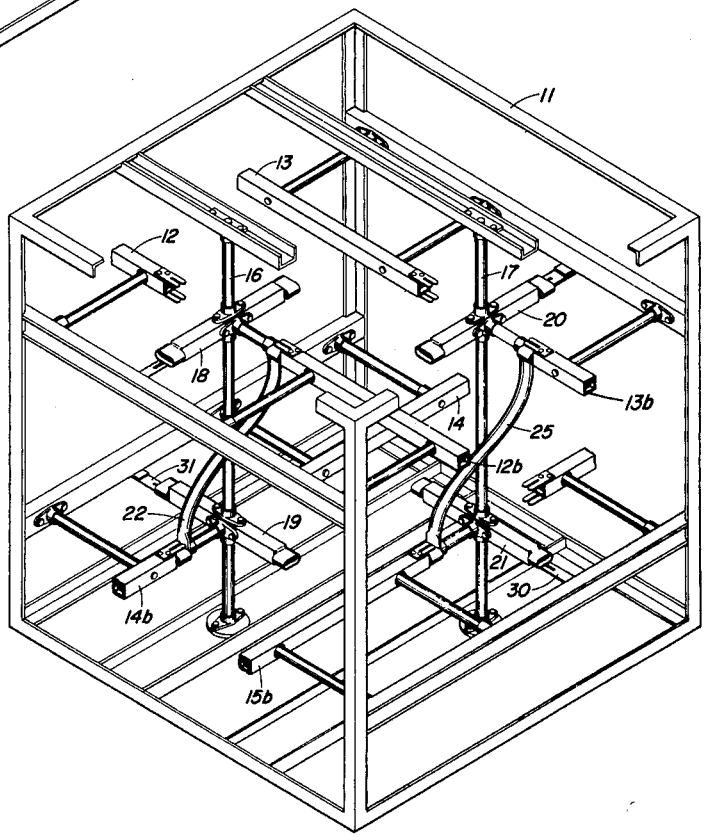
FIG. 2 is an isometric and partially broken view of a single switch module of the present invention illustrating the module in a cross connect configuration.

Referring to FIGS. 1 and 2, a single module of the present invention is illustrated in alternate configurations. The invention is particularly suited for a switch system or switch matrix using balanced lines. As was discussed previously, the switch system is used in coupling a plurality of transmitters or receivers to any one of a plurality of antennas. Although either balanced line or coaxial cable may be used to transmit the signals to the antenna, the present invention relates to antenna systems using balanced lines. The characteristic impedance of a balanced line is somewhat higher than that of a coaxial line, and this characteristic impedance is an inherent function of the transmission line itself. However, to maintain the impedance and prevent unwanted coupling and impedance upset, it is necessary that the two conductors of the balanced line be of an identical length.

In FIG. 1, the module is illustrated with the balanced lines in a straight through or unconnected configuration, while FIG. 2 illustrates them in a cross connected or interconnected relationship. Referring to FIG. 1, a symmetrical frame member 11 is used to house a switch module. Portions of the frame member 11 have been broken away to clearly illustrate the line configuration therein. FIG. 1 illustrates a first pair of balanced line conductors 12 and 13 which may be designated for the purposes of description as an input line, and a second balanced line illustrated by conductors 14 and 15 which may be designated for the purposes of description as an output line. Each of the lines are suspended within the frame member by means of stand off insulators 12*a*, *b* and *c* for line 12; 13*a*, *b* and *c* for line 13; 14*a*, *b* and *c* for line 14; and 15*a*, *b* and *c* for line 15. In the preferred embodiment of the invention, stand off insulators 12*a*–15*c* were constructed of ceramic and joined to the intermediate frame members by means of "crow foot" anchors. Each of the lines has a corresponding supporting frame member 112 for line 12, 113 for line 13, 114 for line 14, and 115 for line 15. These supporting frame members generally run parallel to the input or output line and are spaced symmetrically about frame 11. The symmetrical configuration for the lines 12–13 and 14–15 and their associated supporting framework 112–113 and 114–115 is proportioned and dimensioned to preserve the characteristic impedance of the module, and to preserve balance. This reduces to an absolute minimum the possibility of "cross talk" between conductors.

The sizes of the module, the conductors and the insulators will vary depending upon the power requirements of the switch system. If the switch matrix were constructed for a 100 kilowatt transmitter, the module would be on the order of 20 inches in each exterior dimensions The interior strip line conductors 12–15 would be constructed of 1 inch square copper tubing. For a 250 kilowatt system, the module would be on the order of 36 inches in each dimension, and the interior lines 12–15 would be square copper tubing having a side dimension of 1 1/2 inches to 2 inches. In addition, as the power is increased, it becomes desirable to add silver plating to the copper conductors to reduce conductive losses and resultant heating.

Each of the modules is also equipped with a pair of rotors. These rotatable means are mounted within the frame for interconnecting the input lines and the output lines at two of the crossover points. It is also possible, as will be hereinafter described, to use four rotatable means, one at each point of crossover to provide the capability for multiple matrix configurations. As illustrated in FIG. 1, each of the rotors defines a central insulating shaft portion 16 and 17 which intersects an input conductor and an output conductor. Insulating shaft 16 intersects input conductor 12 and output conductor 14 while insulating shaft 17 intersects input conductor 13 and output conductor 15. The rotor 16 also carries an input line through connect portion 18 and an output line through connect portion 19. Rotor 17 carries an input line portion 20 and an output line portion 21. Each of the rotors also carries a cross connect or interconnect portion. Rotor 16 carries a cross connect portion 22 which is suspended from and spaced apart from the insulating shaft 16 by standoff insulators 23 and 24. The interconnect or cross connect portion 25 is also mounted on shaft 17 by means of standoff insulators 26 and 27. The cross connect portions 22 and 25 are symmetrical in configuration and length. Each is also formed of copper tubing, and may be silver plated to reduce conductive losses.

Each of the cross connect portions and through connect portions is equipped with a specially formed contact means. For rotor 16, the interconnect contact means is indicated at 26, while the contact members for through connect portion 18 are indicated at 27 and 28. Each of the other through connect portions 19–21 and the cross connect portion 25 is also equipped with a specially formed contact means. These contacts, and the associated contacts formed on the input and output lines will be hereinafter discussed with respect to FIGS. 18–20.

FIG. 2 illustrates a single module of the present invention in a cross connect or interconnected configuration. In FIG. 1, the rotors are turned to a through connect position, while in FIG. 2 they are turned to a cross connect position. The input line conductors 12–13 are connected to output line conductors 14–15 by means of the symmetrically formed cross connect portions 22 and 25. As illustrated in FIG. 2 the cross connect portions 22 and 25 define identical and parallel helix portions having 90° or rotation. From the entry point at 13*b*, the separation maintained between the balanced lines, and the length of the conductor between 13*b* and 15*b* is identical to the separation and path length between 12*b* and 14*b*. In each case, the path length uses a short initial conductor, a cross connect portion, and a longer intermediate conductor.

At the point of entry conductor 13 has a short initial conductor 13*b*, while conductor 12 has an intermediate conductor 12*b*. Both use identical length cross connect portions. The output line uses an intermediate output conductor 15*b* (paired with short conductor 13*b*) and a short output conductor 14b (paired with intermediate conductor 12*b*). Thus an equal path length is maintained for each conductor on either side of the balanced line, both before and after switching.

Means are also provided for grounding the unused portions of the rotor. As illustrated in FIGS. 1 and 2, grounding means 30 and 31 ground the through connect portions and cross connect portions when they are not in use.

FIG. 3 is a schematic and diagrammatic illustration of a switch system or matrix formed with the module previously described with respect to FIGS. 1 and 2. As illustrated in FIG. 3, six modules are joined together to provide two input lines and three output lines. Each of the modules 33–38 define a pair of rotors, a pair of input line conductors and a pair of output line conductors. The input and output lines of adjacent modules are interconnected to 39 and 40 define a first balanced input line, while conductors 41 and 42 define a second balanced input line. Conductors 43 and 44 define a first output line, conductors 45 and 46 define a second output line, while conductors 47 and 48 define a third output line. The first balanced input line defined by conductors 39 and 40 is interconnected with the third output line defined by conductors 47 and 48 as indicated by the arrow A in FIG. 3. The rotors 33*a* and 33*b* of the module 33 have been rotated to a cross connect configuration. Similarly, the balanced input line defined by conductors 41 and 42 has been interconnected with the output line defined by conductors 45 and 46 as indicated by the arrow B. The rotors 38*a* and 38*b* are in a through connect configuration to provide for transmission of signals through the module along conductors 41 and 42. Although no signal is impressed upon conductors 43 or 44, they would also define a straight through transmission path for the balanced line signal path indicated by the arrow C.

Figure 12:
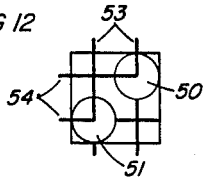
FIG. 12 is a schematic view of the switch module of the present invention in a cross connect configuration.

The parallel and symmetrical path arrangement for the balanced line rotors also defines structural limitations in the construction of the rotors and switches. FIGS. 11–14 illustrate two alternate configurations for the module, and their respective modes of operation. In the module schematically illustrated in FIG. 11, rotors 50 and 51 are positioned to provide either the straight through configuration illustrated in FIG. 11, or the interconnected-left position illustrated in FIG. 12. In FIG. 12, the rotors 50 and 51 have been turned to provide an interconnection or cross connection between the input line 53 and the output line 54. With the rotors constructed as illustrated in FIG. 11–14, it is possible in addition to the straight through connection to connect in only one direction, either left or right. The construction of the rotor makes it impossible to have both a through connect and an interconnect position at the same time. It also makes impossible the interconnection of two input lines to a single output line, or two output lines to a single input line. When an interconnection is made, it breaks the through contact previously established. Thus when output line 54 is interconnected to input line 53, it makes it impossible for any other input lines on the "upstream" side of the module to be interconnected with output line 54. If an interconnection were made on the "downstream" side, it would connect the new signal source with output line 54, but it would simultaneously break the link with input line 53.

Figure 13:
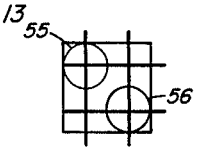
FIG. 13 is a schematic view of an alternate configuration for the module illustrated in FIG. 11.
Figure 14:
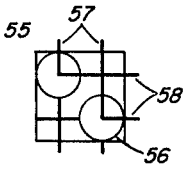
FIG. 14 is a schematic view of a module illustrated in FIG. 13 in a cross connect configuration.

Alternate locations for the rotors are used to provide matrix configurations with the inputs and outputs in both left-right configurations. FIGS. 13 and 14 illustrate a module with rotors 55 and 56 reversed from the position illustrated in FIGS. 11 and 12. In this configuration, the module illustrated in FIG. 13 is in a through connect position, while the module illustrated in FIG. 14 is in a through connect-right configuration. Input line 57 is now interconnected or cross connected to the right to output line 58.

Figure 8:
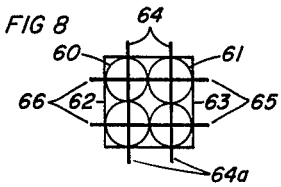
FIG. 8 is a schematic view of an alternate embodiment of the present invention illustrating four rotors in a single module.
Figure 9:
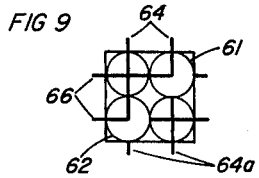
FIG. 9 is a schematic view of the module illustrated in FIG. 8 in a first switch configuration.
Figure 10:
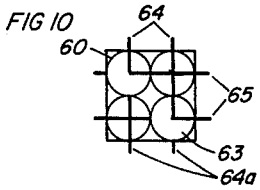
FIG. 10 is a schematic view of the module illustrated in FIG. 8 placed in a second switch configuration.
Figure 11:
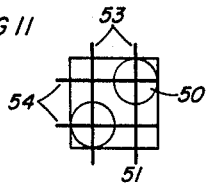
FIG. 11 is a schematic illustration of a switch module constructed in accordance with the present invention.

If it is desired to have multiple switch characteristics within a single module, the module may be constructed with four rotors as illustrated in FIG. 8–10. In these figures, the rotors 60, 61, 62 and 63 are used to connect input line 64 with a straight through output 64*a*, a right output 65, or a left output 66. As illustrated in FIG. 8, the rotors are in a through connect position making connection to 64*a*. As illustrated in FIG. 9, the rotors 61 and 62 have been rotated to provide an interconnect-left configuration to output line 66. As illustrated in FIG. 10, rotors 60 and 63 have been rotated to place input line 64 in an interconnect-right configuration with output line 65.

Figure 6:
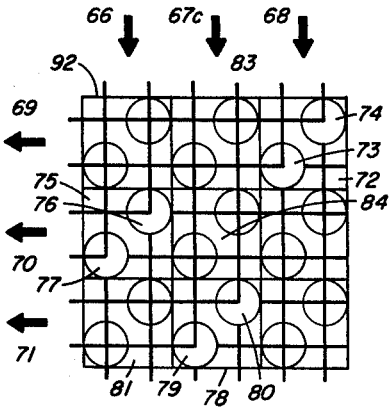
FIG. 6 is a schematic illustration of a switch matrix assembled from a plurality of modules.
Figure 7:
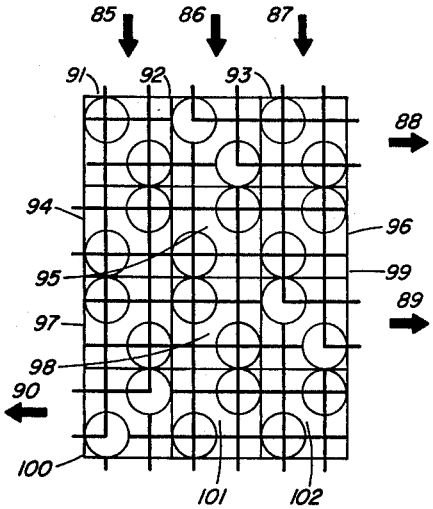
FIG. 7 is a schematic illustration of an alternate matrix configuration.

The various matrix configurations possible with the standard module illustrated in FIG. 11–14 are illustrated in FIGS. 6 and 7. FIG. 6 illustrates a matrix with the input lines 66, 67 and 68 arranged on one side of the matrix and with output lines 69, 70 and 71 on the left side of the matrix. As illustrated in FIG. 6, module 72 has rotors 73 and 74 rotated to an interconnect-left configuration to interconnect input line 68 with output line 69. Module 75 has rotors 76 and 77 rotated to interconnect input line 66 with output line 70. Module 78 has rotors 79 and 80 rotated to an interconnect-left configuration to interconnect input line 67 with output line 71. Modules 81–84 are all in a through connect configuration and provide a portion of the signal path for input lines 66–68 and output lines 69–71. If the rotors for module 92 were inadvertently rotated to an interconnect-left configuration, the interconnection between signal input 66 and 70 would be broken, and the interconnection between input 68 and output 69 would be broken. The only interconnection remaining would be the new interconnection between input line 66 and output line 69. Thus it is apparent that the present invention renders it impossible to provide an inadvertent connection of more than two signal input sources to one output source or load two output lines on a single input source.

If it is desired to use a switch matrix to feed balanced lines to left and right fields, the matrix may be constructed as illustrated in FIG. 7. In this figure, input sources 85, 86 and 87 are interconnected with output signals 88, 89 and 90. The first bank of modules 91, 92 and 93 are arranged to provide an interconnect-right configuration for input lines 85–87. The second bank of modules 94–96 are used to provide an interconnect-left configuration for the input lines 85-87. The third bank of modules 97–99 are used to provide an interconnect-right configuration for the input lines 85–87. The last bank of modules 100–102 are used to provide a second interconnect-left configuration for the input lines 85–87. Thus as illustrated in FIG. 7, it is possible to have interconnect-right and left configurations in the same matrix.

Figure 5:
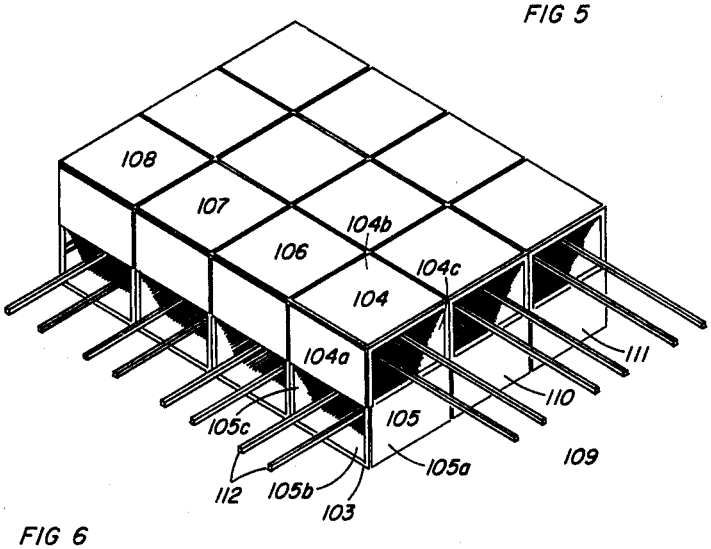
FIG. 5 is an isometric view of a plurality of switch modules assembled together in a switch matrix wherein each of the modules is fully shielded.

FIG. 5 illustrates the shielding supplied with each module to reduce "cross talk" between adjacent lines. Each of the modules, such as the module illustrated at 103, is equipped with upper and lower shielding members 104 and 105. The upper shielding member 104 actually comprises 3 separate panels, 104*a*, 104*b* and 104*c* which extend around 3 sides of the module. Likewise, the shielding panel 105 comprises 3 panels 105*a*, 105*b* and 105*c*. This provides shielding between each pair of balanced lines except at the point of crossover. The upper shielding members 104, 106 and 107 and 108 define a U-shaped channel for the input line 109. Likewise, panels 105, 110 and 111 provide a U-shaped shielding conduit for output lines 112. If this construction is employed throughout the matrix, each set of input and output lines is adequately shielded from the other.

FIG. 21 is a schematic drawing of the invention with the cross-connect portions 22 and 25 arranged to that they turn inward when the module is in the through connect mode. In this arrangement capacitive coupling between the crossing lines through the cross connect portions can be eliminated thereby avoiding the necessity of grounding the cross-connect contact assemblies when out of the circuit to prevent cross talk.

The electric fields of the two sides of a given line are equal in amplitude and opposite in phase so that a voltage null exists at the midpoint between the two line conductors. For the same reason, i.e., equal amplitude and opposite phase of the two sides of the line, if the switch configuration is dimensioned so that when out of the circuit the turn contact assemblies are electrically centered between the sides of the lines no voltage is induced in them and no coupling exists between the crossing lines due to their presence. When the lines are balanced the value of stray capacity 3*a* would equal the value of stray capacity 3*b*, and likewise, the value of capacity 2*a* would equal that of 2*b*. As illustrated in FIG. 21, capacity $1a=1b$; $2a=2b$; $3a=3b$; and $4a=4b$. If these lines were rotated to the outside and grounded, they would tend to disrupt the continuously distributed capacitance between the conductor and its associated shielding. As the operating frequency of the switch is extended to very high frequency and ultra high frequency range, the disruption becomes more and more pronounced.

The contact structure used in the present invention is illustrated in FIGS. 18-20. In the preferred embodiment of the invention, 1 inch square copper tubing indicated as 113 in FIG. 18 is notched with two parallel cuts indicated by cutout portions 114 and 115. The terminal portion 116 of the copper bar is then deformed as illustrated in FIG. 19 to provide a contact means with rounded shoulders as indicated at 117. The remaining sidewalls 118 and 119 provide transition pieces between the conductor 113 and the contact 117. As indicated previously, it may be desirable to silver plate the contact or the entire conductor 113 to minimize surface losses. In the preferred embodiment of the invention, the contact illustrated in FIG. 19 is formed as the movable contact for both the through connect portions and the interconnect or cross connect portions. The stationary contact is described in FIG. 20.

FIG. 20 illustrates a stationary input or output line 120 having a pair of first 121 and second 122 stationary flexible point contact means. Each of these flexible means is bifurcated as indicated by the cuts 123 and 124 and provided with point contacts such as illustrated at 125, 126 and 127. By reducing the diameter at the point of contact of the contacts 125–127, the effective pounds per square inch pressure of the contact is raised, so that a better metal to metal contact is achieved. The cross sectional area of the contact at the point of contact is reduced, but so is the length of the point of contact. This means the conductive path at the point of contact is extremely short and has a very low loss. The heat generated by the contact is therefore reduced and minimizes the contact problems normally associated with large power switches.

The means and circuitry for rotating the rotors used in the present invention is illustrated in FIGS. 4, and 15–17. As illustrated in FIG. 4, each of the rotors provides main switch means 130 and 131 which are rotated by the apparatus illustrated schematically in FIG. 4. The main switch means is to be alternately and intermittently rotated through a predetermined angle of rotation between the first and second main switch positions. As indicated previously, rotation is approximately 90°, and may be either to the left or to the right, depending upon the module configuration. Each of the rotors also rotate in opposite directions. The main switch means is provided with a cam 132 which is also rotatable between first and second switch positions by the rotation of switch means 131. As illustrated in FIG. 4, all components aligned along axis 133 rotate together, while those components aligned along axis 134 rotate together. Each of the components is rotatable through the angles illustrated by the letters D and E. A reversible motor means 135 is also provided to rotate the main switch in a clockwise direction when a first field application is made, and to rotate the main switch in a counterclockwise direction when a second field application is made. A drive means generally indicated at 136 is used to interconnect the reversible motor means and the main switch means. First 137 and second 138 switch means are mounted adjacent to first and second main switch positions, with the first switch means being opened as the main switch is rotated to its first position, and the second switch means being opened as the main switch is rotated to its second position. A three-way circuit means is provided with a single three-way switch, 139, conductors 140, 141 and 142 and the first and second switch means 137 and 138. This circuit provides a field application to motor 135 along one side of the threeway switch 139, conductor 141 and switch means 138. It also provides a second field application including the other side of switch 139, conductor 140, and switch means 137. The common conductor for the three-way circuit is indicated at 142. The power source is indicated at 143 and is applied to motor 135 through either side of the three-way switch 139 to provide first and second field applications across common conductor 142 on one side. A first field application is made through three-way switch 139, conductor 140, first switch means 137, and conductor 144. This rotates the first switch means 130 in a counterclockwise direction, as indicated by the arrow F, and the second switch means 131 in a clockwise direction as indicated by the arrow G. When the second rotor 131 has rotated to its second position, cam means 132 will open switch means 137 thereby opening the field application to motor 135. At the start of this field application switch means 138 was closed by cam means 132 to provide for rotation of the drive means in the opposite direction when three-way switch 139 is thrown to its alternate side. When switch 139 is thrown to the other pole, it will interconnect conductor 141, switch 138 (which is now closed) and conductor 145 to effect a second field application at motor means 135.

The switch means 130 and 131 are linked together by means of flexible drives 146 and 147. In the preferred form of the invention, flexible drives 146 and 147 comprise chains, and members 148, 149, 150 and 151 comprise sprocket drive wheels. Chain 146 is securely anchored to sprocket 148 as indicated at 152, while being securely anchored to sprocket 149 as indicated at 153. Chain 147 is securely anchored to sprocket 151 as indicated at 154, while being anchored to sprocket 150 as indicated at 155. The use of flexible drive chains and sprockets is lower in cost than the use of a pair of idler spur gears, and is more reliable and precise than the use of flexible cables and drive sheaves. Relative adjustment between the sprocket members 148-151 and the switch rotors is achieved by means of the adjustment slots 156 and 157 together with bolt means 158. Bolt means 158 is secured in drive plate 159 and clamps the sprocket members 148 and 151 in their respective angular positions. Sprocket means 149 and 150 are also fixed to drive wheel 160 and drive plate 161 by means of pin 162 which extends through all of the members to secure them in a fixed angular relationship. Drive plate 161 is also equipped with a stop means 162 which cooperates with another stop (not shown) mounted on the frame of the module. Drive plate 160 is connected to the drive means 136 by means of a flexible chain 163. Drive means 136 comprises a worm gear 164, a spur gear 165, and a clutch means which includes a friction plate 166 and a drive plate 167. The friction plate 166 may be disengaged by means 170 when it is desired to rotate the drive means by hand. In this event, a hand crank 171 is attached to a socket extension 172, and the assembly can be disengaged from drive plate 167.

Motor means 135 is connected to the clutch drive plate 167 by means of a stub shaft 173, sprocket 174 and a chain means 175.

Figure 15:
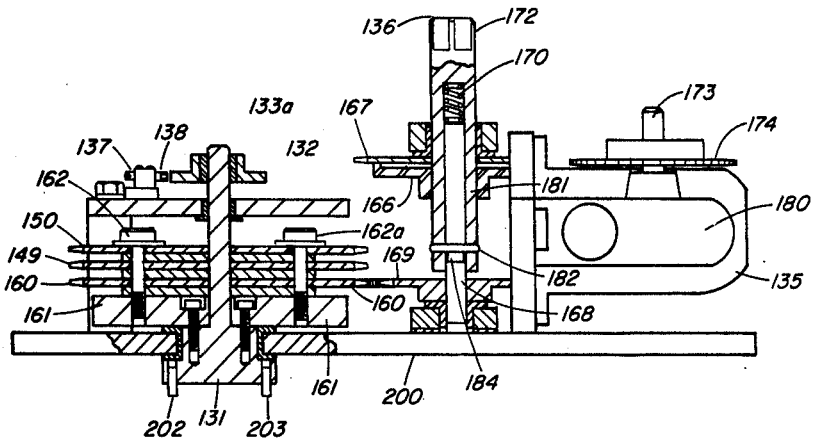
FIG. 15 is a cross sectioned view of the drive means used to rotate the switch rotors of the present invention.
Figure 16:
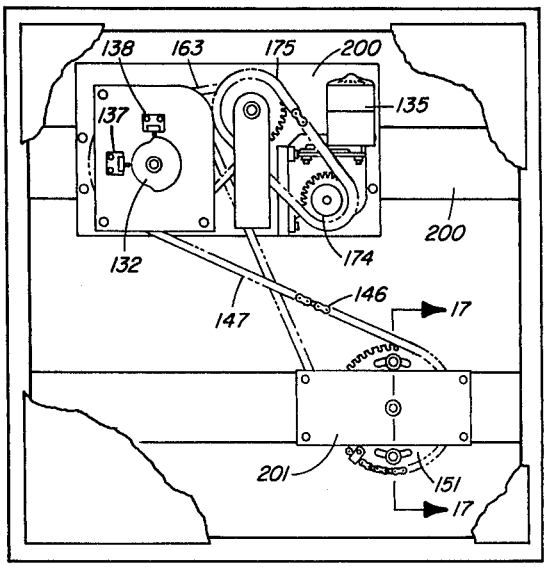
FIG. 16 is a partially broken plan view of the drive means used to rotate the switch rotors of the present invention.
Figure 17:
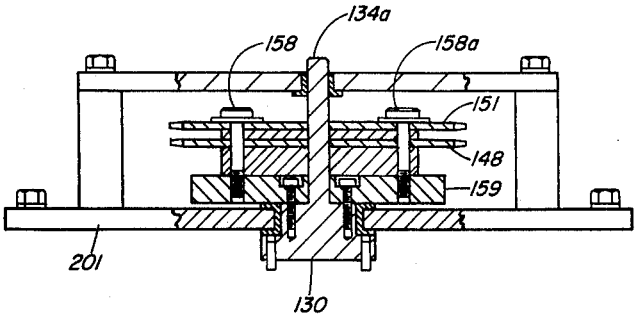
FIG. 17 is a cross sectional view taken along section lines 17:17 in FIG. 16.

FIGS. 15–17 illustrate the drive means for the switch means in a cross sectioned view. As illustrated in FIG. 15, the drive means is mounted on a subframe 200 and comprises the motor 135, a gear housing 180 for housing worm gear 164 and spur gear 165. The drive is then translated along stub shaft 173 to the drive sprocket 174. Chain means 175, illustrated in FIG. 16 then drives the clutch drive plate 167. The drive is then transmitted through friction plate 166, collar 181, and pin means 182 to the interior shaft 168 and drive sprocket 169. As illustrated in FIG. 15, spring means 170 resiliently biases collar 181 upwardly thereby urging friction plate 166 into engagement with the clutch drive plate 167. The friction plate 166 is fixably secured to collar means 181. This torque is transmitted form the collar 181 to shaft 168 by means of pin 182. When it is desired to de-activate the clutch and operate the switch by hand, the hand crank 171 is afixed to the shaft extension 172 and the extension and collar 181 are urged downwardly as illustrated in FIG. 15. This downward movement compresses spring means 170 and disengages the friction plate 166 from clutch drive plate 167. Pin 182 is free to move within the slot 184 cut in shaft means 168. Drive sprocket 169 is fixably secured to shaft 168. Drive means 136 is connected to switch means 131 by a sprocket 160 and drive chain 163 as illustrated in FIG. 16. As hereinbefore previously described, drive sprocket 160 is securely linked to drive plate 161 and sprockets 149 and 150 by means of bolts 162 and **162*a*. Cam means 132 is also mounted for rotation on shaft 133*a* to actuate switch means 137 and 138. The relative angular relationship of the switch means 137 and 138 is more fully illustrated in FIG. 16. In actual practice, each of the first and second switch means indicated at 137 and 138 may embody two or more switches, each of which is actuated by the relative angular position of cam means 132. In addition to the first and second switch means described with respect to FIG. 4, it is common to provide an interlock switch to shut down the transmitter immediately prior to switching in the event the switch is inadvertent and the transmitter has yet to be shut down. It may also be desirable to provide a third set of contacts for switch means 137 and 138 to provide a remote readout at a station console. The switch means 131 is equipped with first and second pins 202 and 203 which engage the rotors of the module as previously described. As illustrated in FIG. 1, the "switch means" 131 is fixably secured to rotor shaft 16 by means of pins 202 and 203 which engage a standard crow foot adapter 204**.

Referring to FIGS. 16 and 17, a second frame member 201 is also provided to provide a secure anchor point for the drive means of the second rotor. Switch means 130 is integrally formed with shaft **134*a*, and carries a drive plate 159 and sprockets 148 and 151. These sprockets are linked together as hereinbefore previously described by bolts 157*a* and 158*a*. These sprockets are rotated as hereinbefore previously described by drive chains 146 and 147. Although the configuration illustrated and described with respect to FIGS. 4, 15 and 17 illustrates a specific drive means for the present invention, it should be understood that another drive means could be combined with the switch module of the present invention, or the reversing drive and circuitry illustrated in FIG. 4 could be adapted to a different type of switch module. As illustrated in FIG. 4, switch means 137 and 138 are normally opened, but are closed by cam 132** when the cam arrives at its first or second position. The choice of normally opened or normally closed is dependent entirely upon the choice of cam configuration.

While I have thus far described the preferred embodiments of the invention, other variations will be suggested to those skilled in the art. It must therefore be understood that the foregoing illustration is meant to be illustrative only, and not limitive of the present invention; sand all such variations and modifications as are in accord with the principles described are meant to fall within the scope of the appended claims.

I claim:

1. Remote control means for a balanced line switch system said means including:

a. intermittently driven balanced line main switch means, said means defining first and second pairs of balanced line conductors arranged in a crossbar matrix and a pair of rotatable means arranged between said balanced line conductors, each of said rotatable means having identical helix portions defining 90° of rotation, each of said rotatable means being intermittently rotatable through 90° of rotation, b. drive means for rotating said pair of rotatable means through 90° of rotation in response to a first circuit application and reversing said rotation in response to a second circuit application, c. cam means mounted on one of said rotatable means for actuating a first and second control switch means, d. three-way switch means interconnected with said first and second control switch means to effect a first field application to said drive means while in a first position and a second field application to said drive means when in a second position.

2. A circuit means as claimed in claim 1 wherein each of said rotatable means rotates in opposite directions, each of said rotatable means being linked to the other by first and second flexible drive means.

3. An automatic circuit as claimed in claim 1 wherein said drive means comprises a slip clutch interposed between a motor means and said rotatable means, said combination also including a pair of stop means adjacent said cam means for indexing said rotatable means and defining said 90° of rotation.

4. An automatic circuit as claimed in claim 3 which further comprises a manual override means for disengaging said slip clutch and providing a handle means for rotating said rotatable means through 90° of rotation.

5. An automatic circuit as claimed in claim 1 wherein said first control switch means is normally closed but opened by said cam means as said rotatable means completes 90° or rotation, said second switch means being normally closed but opened by said cam means after said rotatable means has been reversed through 90° of rotation.

6. Remote control means for a balanced line switch system comprising:

a. Balanced line main switch means to be remotely controlled, said main switch means including first and second pairs of input and output balanced line conductors, and a pair of helical rotatable cross connect means to be alternately and intermittently rotated through a predetermined angle of rotation between first and second main switch positions, b. cam means mounted for rotation with one of said rotatable cross connect means, c. reversible motor means and drive means for rotating said pair of rotatable cross connect means and said cam means, said drive means rotating said pair of rotatable cross connect means in opposite directions in response to a first field application, and reversing said direction of rotation in response to a second field application, d. first and second control switch means mounted adjacent said cam means, said first control switch being actuated by said cam means as said cross connect means is rotated to its first main switch position. said second control switch means being actuated by said cam means as said cross connect means is rotated to its second main switch position, e. three-way circuit means, said means including a single three-way switch and said first and second control switch means for providing a first field application to said motor means when said rotatable cross connect means is in its first main switch position, and a second field application to said motor means when said rotatable cross connect means is in its second position.

7. A remote control means for a balanced line switch system as claimed in claim 6 wherein said first control switch means is normally closed but opened by said cam means as said cross connect rotor arrives at its first main switch position, said second control switch means being normally closed but opened by said cam means as said cross connect rotor is in its second position.

8. A remote control means for a balanced line switch system as claimed in claim 6 wherein said drive means includes a slip clutch means between said reversible motor means and said cross connect means.

9. A remote control means for a balanced line switch system as claimed in claim 6 which further comprises first and second flexible drive means between said pair of cross connect means.

* * * * *